US010441003B2

(12) United States Patent
Goodwin et al.

(10) Patent No.: US 10,441,003 B2
(45) Date of Patent: Oct. 15, 2019

(54) X-SHAPED BRASSIERE SUPPORT AND BRASSIERE INCORPORATING SUCH SUPPORT

(75) Inventors: Clare Goodwin, Hong Kong (CN); Louise Yip, Hong Kong (CN)

(73) Assignee: Clover Mystique Co. Limited, Hong Kong (HK)

( * ) Notice: Subject to any disclaimer, the term of this patent is extended or adjusted under 35 U.S.C. 154(b) by 956 days.

(21) Appl. No.: 13/410,276

(22) Filed: Mar. 1, 2012

(65) Prior Publication Data

US 2013/0065485 A1 Mar. 14, 2013

Related U.S. Application Data

(60) Provisional application No. 61/448,211, filed on Mar. 2, 2011.

(51) Int. Cl.

| | |
|---|---|
| ***A41C 5/00*** | (2006.01) |
| ***A41C 3/10*** | (2006.01) |
| ***A41C 3/14*** | (2006.01) |

(52) U.S. Cl.

CPC ..... *A41C 5/005* (2013.01); *A41C 3/10* (2013.01); *A41C 3/142* (2013.01)

(58) Field of Classification Search

CPC ..... A41C 3/10

USPC ..... 450/1, 41, 43–45, 48–53, 39, 92, 54–55, 450/40, 74

See application file for complete search history.

(56) References Cited

U.S. PATENT DOCUMENTS

| | | | | |
|---|---|---|---|---|
| 2,202,058 A | | 5/1940 | Malnick | |
| 2,468,106 A | * | 4/1949 | Polk et al. | 450/53 |
| 2,636,174 A | | 4/1953 | Williams | |
| 3,186,412 A | | 6/1965 | Kurland | |
| 3,202,565 A | * | 8/1965 | Loftin | 428/175 |
| 3,528,430 A | * | 9/1970 | Elaine | 450/41 |
| 5,820,443 A | | 10/1998 | Burr | |
| 6,000,994 A | * | 12/1999 | Salotto | 450/92 |
| 6,394,844 B1 | | 5/2002 | Frias Valero et al. | |
| 6,439,959 B1 | * | 8/2002 | Magrone et al. | 450/41 |
| 6,966,815 B2 | * | 11/2005 | Weinerth | A41C 3/10 450/39 |
| 6,996,815 B2 | | 2/2006 | Bourke-Dunphy et al. | |
| 7,244,167 B2 | | 7/2007 | Falla | |
| 7,604,526 B2 | | 10/2009 | Liu | |
| 7,731,564 B2 | * | 6/2010 | Sanders | 450/54 |
| 7,833,082 B2 | | 11/2010 | Bugada | |

(Continued)

FOREIGN PATENT DOCUMENTS

| | | |
|---|---|---|
| CN | 1174686 A | 3/1998 |
| CN | 2476977 Y | 2/2002 |

(Continued)

OTHER PUBLICATIONS

Russian Office Action for Russian Application No. 2013138634/12 dated May 15, 2015 with English translation.

*Primary Examiner* — Alissa J Tompkins

*Assistant Examiner* — Brieanna Szafran

(74) *Attorney, Agent, or Firm* — Muncy, Geissler, Olds & Lowe, P.C.

(57) ABSTRACT

X shaped brassiere support and unwired brassiere incorporating such support. The X shaped support has four forks joined at a joint point and is molded in a 3-dimensional configuration conforming to the shape of a brassiere's cups, providing the shaping and uplifting effects for brassieres.

13 Claims, 8 Drawing Sheets

(56) References Cited

U.S. PATENT DOCUMENTS

| | | | | |
|---|---|---|---|---|
| 7,862,401 | B2 | 1/2011 | Watrin et al. | |
| 8,137,155 | B2 | 3/2012 | Horii et al. | |
| 2002/0022432 | A1 | 2/2002 | Magrone et al. | |
| 2004/0029485 | A1 | 2/2004 | Pagliarulo et al. | |
| 2004/0053557 | A1* | 3/2004 | Moyer | 450/41 |
| 2005/0075048 | A1* | 4/2005 | Legaspi et al. | 450/41 |
| 2005/0085161 | A1* | 4/2005 | Klakauskas | 450/57 |
| 2005/0221718 | A1 | 10/2005 | Falla | |
| 2006/0240743 | A1 | 10/2006 | Mitchell | |
| 2007/0298682 | A1 | 12/2007 | Liu | |
| 2010/0317256 | A1 | 12/2010 | Zhang | |

FOREIGN PATENT DOCUMENTS

| | | | |
|---|---|---|---|
| CN | 1678209 | A | 10/2005 |
| CN | 1713830 | A | 12/2005 |
| CN | 174155 | A | 3/2006 |
| CN | 2800835 | Y | 8/2006 |
| CN | 101161137 | A | 4/2008 |
| CN | 201127302 | Y | 10/2008 |
| CN | 201135143 | Y | 10/2008 |
| CN | 101536814 | A | 9/2009 |
| DE | 20 2010 012 320 | U1 | 12/2010 |
| EP | 1 226 767 | A2 | 7/2002 |
| FR | 1065864 | | 5/1954 |
| GB | 452307 | | 8/1936 |
| WO | WO 01/08518 | A1 | 2/2001 |
| WO | WO 2004/034828 | A1 | 4/2004 |
| WO | WO 2004/049839 | A1 | 6/2004 |
| WO | WO2009/101287 | A2 * | 8/2009 |

* cited by examiner

X-SHAPED BRASSIERE SUPPORT AND BRASSIERE INCORPORATING SUCH SUPPORT

CROSS-REFERENCE TO RELATED APPLICATION

This application claims benefit from U.S. provisional application No. 61/448,211, filed Mar. 2, 2011, the content of which is incorporated herein by reference.

FIELD OF THE INVENTION

This invention relates to a 3-dimensional support for a brassiere and relates to a brassiere that comprises such a support.

BACKGROUND OF THE INVENTION

The primary function of a brassiere is to enhance the wearer's comfort by providing support for the breasts. It can also enhance women's cleavage and their breasts' perceived shape. Presently, bras are mostly having wires on cups to help the cups fit close to body and conform the breast root, to create a nice profile of breast, and to give maximum push up effect. The wire is usually made of rigid metal or plastic. However, one disadvantage of the wired bra is irritation to wearer after long hours, sometimes the ends of the wire make poke the breasts causing reddish and uncomfortable. Particularly, the wire can create pressure to the wearers' armpit or cleavage between the breasts and tendency to dig into the breast tissues, causing irritation and leaving red marks. In some serious cases, the sharp end of the wire could penetrate through the fabric material and scratch the skin and possibly physical injuries. In order to prevent this problem from happening, a dense wire channel is usually used to cover the wire.

There are also non-wired varieties of brassiere in the market for users who do not like wired brassieres. While not causing irritation to the breasts, the unwired brassiere cannot uplift the cleavage like a wire bra does when it is not stiff enough or it cannot conforms the curvature of the breasts and can be very uncomfortable to the wearer when it is stiff enough for the uplifting or shaping effects.

International Application No. PCT/US03/18595 disclosed an anti-roll support for brassieres. It is 2D-shaped plastic sheet material which, according to the specification, has sufficient stiffness to provide desired lifting or holding support while readily conforms to various body curvatures for increased wearing comfort. However, this support is required to adhere directly to the fabric comprising the body-shaping garment using a film or hot melt adhesive. Because it is 2-D sheet material and is forced to conform the 3-D shaped garment fabric by an adhesive, there is a residual torque in the combined layered materials (i.e., the garment fabric layer and the plastic support layer bended to conform the shaped garment parts by an adhesive). Perhaps, this residue torque exerted by the plastic support of certain stiffness makes it undesirable to have a single integral piece of support for shaping both wearer's breasts ("a brassiere comprising a single shaped-support for supporting both breasts may be less comfortable than a brassiere comprising independent supports, and is therefore not preferred", see lines 18-21, page 7).

In view of the prior art, there is need for a better design of unwired brassieres.

SUMMARY OF THE INVENTION

Accordingly, one object of the present invention is to provide an unwired brassiere which can provide uplifting and shaping effects like what are provided by a metal or plastic wire and, at the same time, provide the lightness and comfort like an unwired brassiere. This object is achieved by using a 3-dimensional shaped support, which is an integral piece for supporting both cups of the brassiere and which are embedded in the cups but harbors no residue torque.

Another object of the present invention is to provide a cost-effective method of making comfortable unwired brassieres. This object is achieved by using a single integral piece of X-shaped support for both cups of the brassiere and by including such support into the same molding process when the cups are molded. Therefore, this process of fabricating the brassiere is simple and does not significant increase the cost.

The various features of novelty which characterize the invention are pointed out with particularity in the claims annexed to and forming a part of this disclosure. For a better understanding of the invention, its operating advantages, and specific objects attained by its use, reference should be made to the drawings and the following description in which there are illustrated and described preferred embodiments of the invention.

DETAILED DESCRIPTION OF PARTICULAR EMBODIMENTS OF THE INVENTION

The present invention is now described below in detail with reference to the figures.

Figure 1:
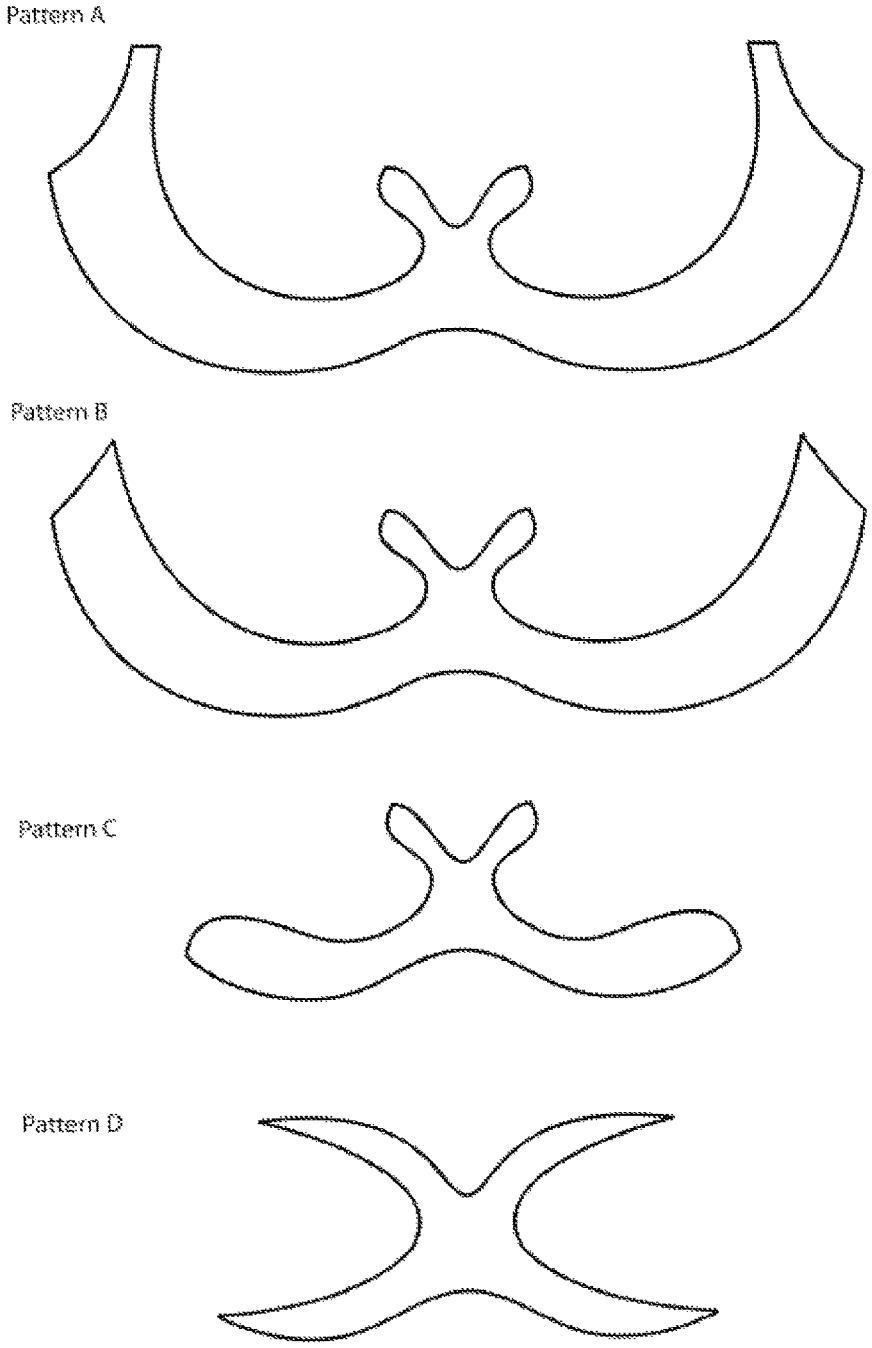
FIG. 1 shows some patterns of the X shaped brassiere of the present invention.
Figure 2:
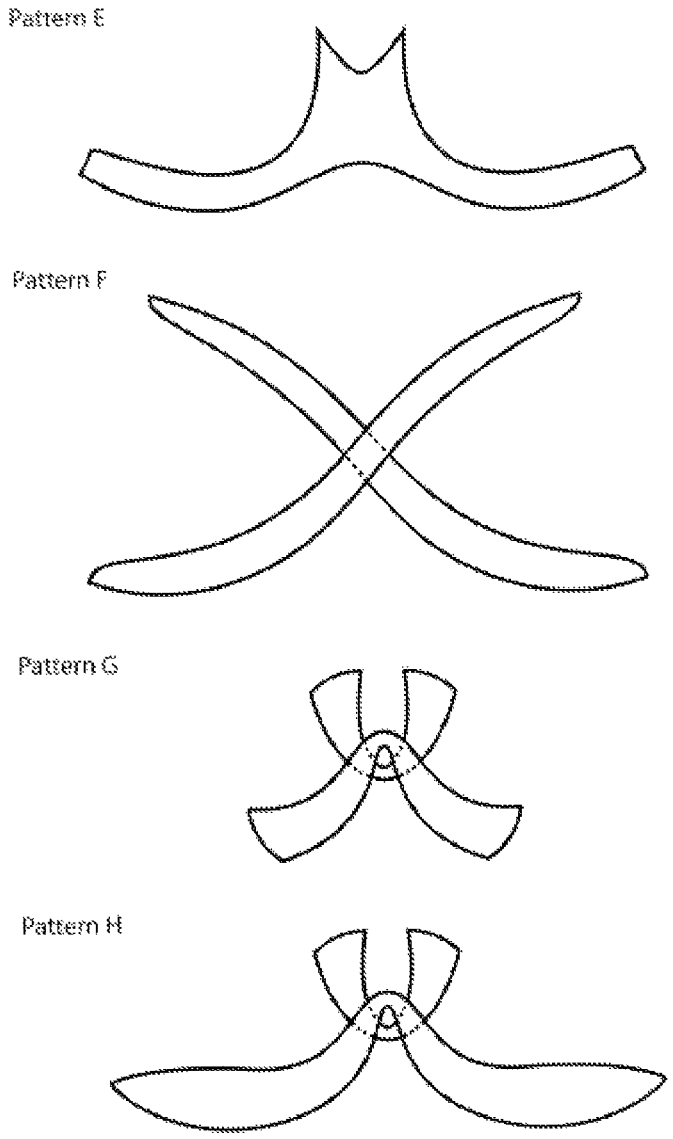
FIG. 2 shows some additional patterns of the X shaped brassiere of the present invention, which are made from two elements with an overlapping area.

Turning first to FIG. 1, there is shown some preferred examples of the pattern design for making the 3-dimentional brassiere support of the present invention. Additional pattern examples can be found in FIG. 2. It is understood that the examples provided on FIGS. 1 and 2 are for the purpose of illustration of the present invention, but not as the limitation of its scope. The design and selection of the pattern is an important feature in practicing the present invention, because a proper pattern provides both adequate support to the breasts and comfortable wearing experience. As it is noted from the samples provided in FIG. 1 and FIG. 2, a proper pattern should be in a general "X" shape, which can be a single piece or can be formed from two pieces with some overlapped area as shown in patterns F-G of FIG. 2.

Other variations of the X shape are possible and may also provide satisfactory results. For the purpose of this invention, the "X-shape" means a shape having four forks joined at a joint point, with two left forks supporting the left cup and two right forks supporting the right cup. The X shaped support of the present invention is preferably made of 100% EVA (Ethylene Vinyl Acetate), which can be purchased in the market as common commodities. Other materials may also be used, such as, for example compressed polyurethane, fiberfill or similar materials that can form a 3-dimentional curved shape after the process of heat or cold molding or injection molding. In the particular embodiment where the EVA sheet (which can be in a form of net or mesh) was used as the starting material, the EVA sheet is cut into a designated X shape by any cutting technology used in the art, for example, manual-cutting, die-cutting (or stamp cutting), laser-cutting or CNC (computer numerically controlled) cutting. The thickness of the X shaped support can be from 0.1 to 200 mm, measured before or after compression. A person of ordinary skill in the art is capable of selecting a proper material of a proper thickness and a cutting method according to the specific circumstance, which are not limitations to the scope of the present invention. The detailed steps of making X-shape supported brassiere are described in the following.

Figure 3:
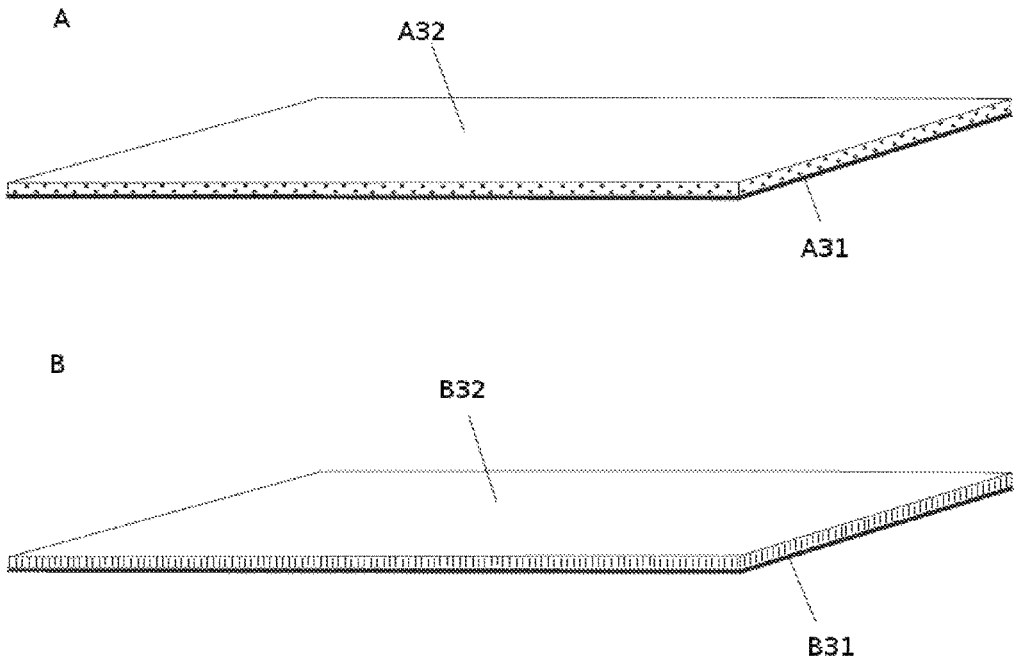
FIG. 3 shows diagrams depicting the outer cup panel and inner cup panel for making unwired brassiere of the present invention.

Making Outer and Inner Cup Panel:

A fabric sheet is laminated to a foam sheet to form an outer cup panel and/or inner cup panel. As an example, the fabric sheet is a 100% knitted polyester fabric and the foam sheet is 100% polyurethane foam. Of course, other materials may also provide satisfactory results as the fabric sheet and the foam sheet, the selection of which are within ordinary skill of the art. The outer cup panel and the inner cup panel may be made from the same laminated panel. Or, as shown in FIG. 3, outer cup panel A and inner cup panel B may have different fabric linings (A31, B31) and/or different foam sheets (A32, B32). The outer and inner cup laminated panel may be trimmed (by manual, CNC, or die cutting) to a suitable size and shape prior to proceeding to the next step.

Figure 4:
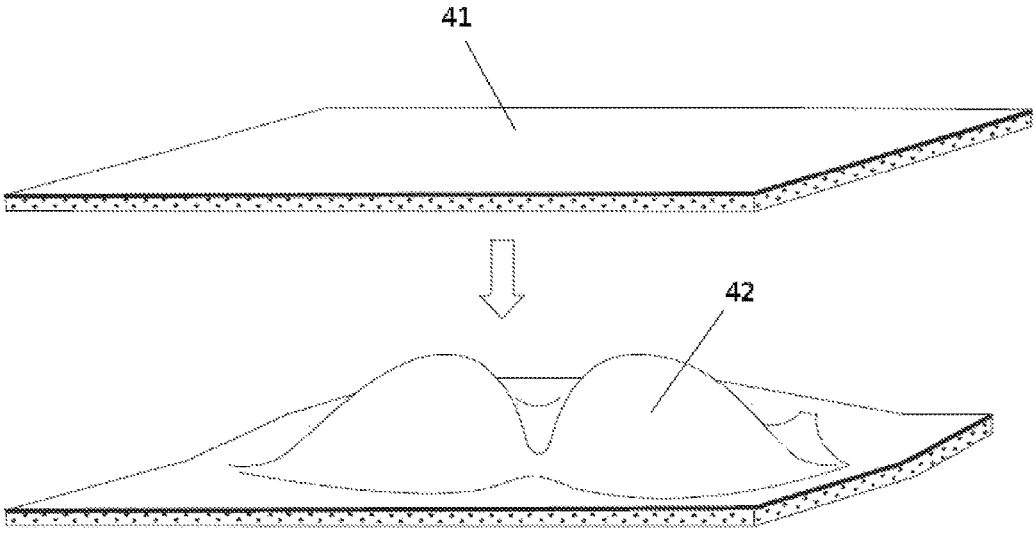
FIG. 4 shows that a flat laminated outer panel is molded to form a pair of brassiere cups.

Molding Outer Cup Panel:

The outer cup panel is placed between the male and female of a heated aluminum mold with the temperature adjusted according to the type of material used in the panel. The male and female molding halves are then closed. After a designated time passes, the halves are opened. A pair of molded cups (which may also be made one at a time) is formed. The FIG. 4 shows that a flat laminated outer panel 41 is molded into a pair of brassier cups 42.

Figure 5:
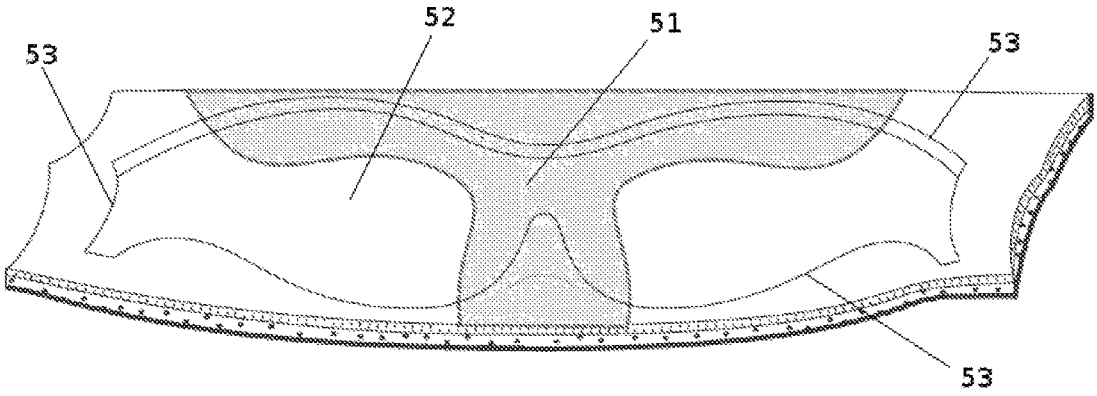
FIG. 5 is a 2-D view showing the relative positioning of the X shaped support on the outer cup panel.
Figure 6:
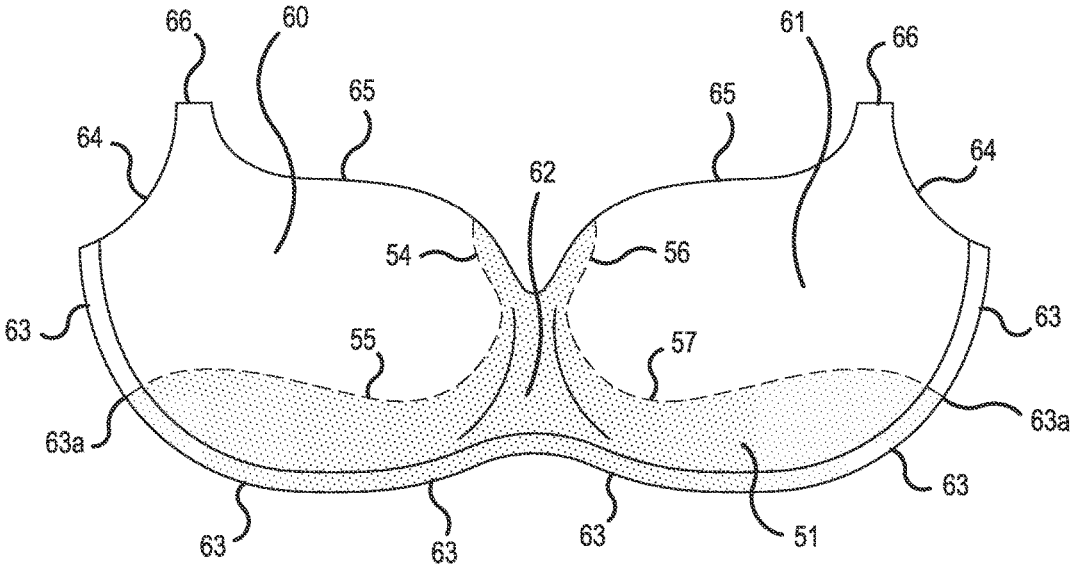
FIG. 6 is a 2-D schematic representation of a pair of brassiere cups according to the present invention.
Figure 8:
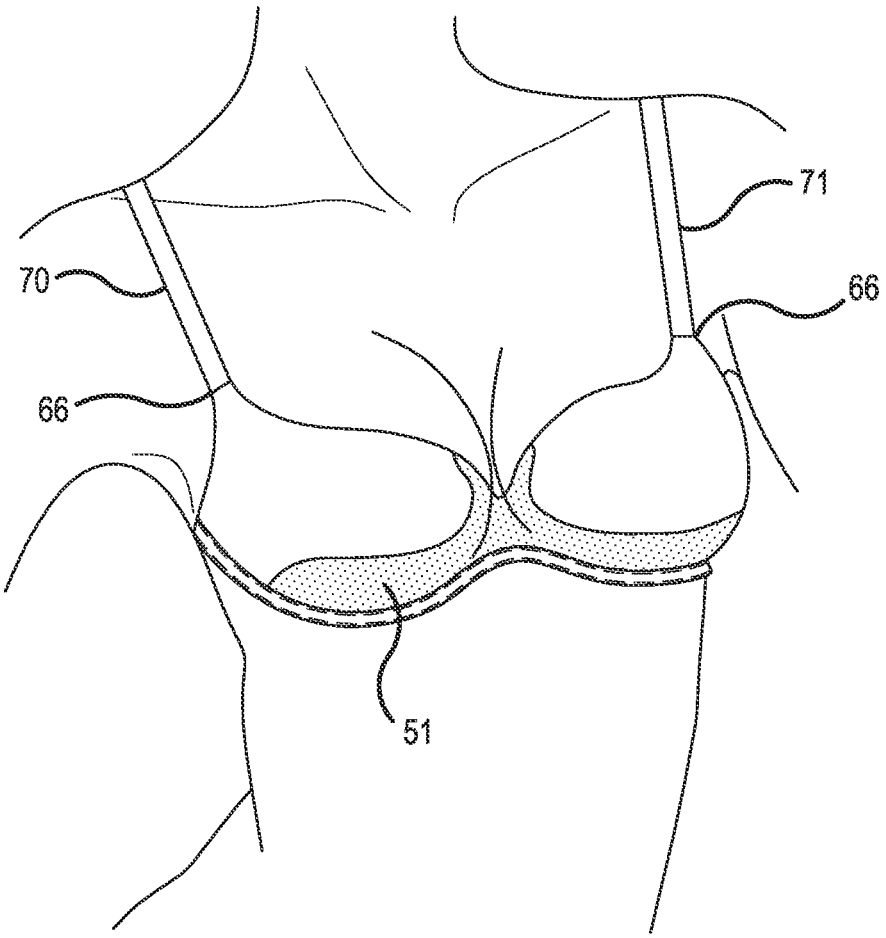
FIG. 8 illustrates the brassiere with X shaped support of the present invention fitted on simulated models.

Molding X-Shaped Support Between Outer and Inner Cup Panels:

Adhesive is applied on the foam surface of molded cup of the outer cup panel made from the above step, on one or both surfaces of the X-shaped support, and on the foam surface of the inner cup panel. Next, the X-shaped support is positioned on the foam surface of the inner cup panel to form a flat assembled support-inner panel (alternatively, the X-shaped support may also be positioned on the foam surface of the outer cup panel covering part of the rim area of the molded cups thereon). Then, the molded outer cup panel is placed on the female of a heated aluminum mold, followed by positioning the assembled support-inner panel on the molded outer cup panel in a way that the X-shaped support is between the outer and inner cup panels. The male of the mold is then put in position to clamp the molded outer cup, the X shaped support and the inner cup panel together for a predetermined time to produce a finished molded cup shape. FIG. 5 is a 2-D view showing the relative positioning of the X shaped support 51 on the inner cup panel 52, on which engraved lines 53 are provided for final trimming. After trimming along the engraved lines by scissors, bandknife, sewing machine or stamp cutting, finished brassiere cups are formed as shown in FIG. 6. Because of the plasticity of the material of the X-shaped support, once molded, it assumes a conforming 3-dimensional shape within the finished molded cups without exerting any residual torque. While not being bound by theory, it is believed that this makes possible that both breasts can be supported by a single integral support without causing any uncomfortable feel. FIG. 6 specifically shows the, right, cup 60 and the left cup 61 of the brassiere including the X-shaped support 51. The X-shaped support 51 includes the upper right fork 54, the lower right fork 55, the upper left fork 56 and the lower left fork 57. Furthermore a bride portion 62 is provided between the right and left cups 60, 61 and each of the right and left cups 60, 61 includes a lower area 63, a side area 64, an upper area 65 and a shoulder strap attachment area 66. FIG. 6 depicts the positioning of the X-shaped support 51, in which the lower right fork 55 extends from the bridge portion 62, along the lower area 63 of the right cup 60 and terminates at a lower portion 63*a* of the lower area 63 of the right cup 60 that is before the side area 64, and in which the lower left fork 57 extends from the bridge portion 62, along the lower area 63 of the left cup 61 and terminates at a lower portion 63*a* of the lower area 63 of the left cup 61 that is before the side area 64. Each of the upper right and left forks 54, 56 extend from the bridge portion 62 and along an inside portion of the upper area 65 of the right and left cups 60, 61, respectively. FIG. 8 illustrates the brassiere with X shaped support 51 of the present invention fitted on simulated models, as well as a right shoulder strap 70 and a left shoulder strap 71 attached at the shoulder strap attachment area 66 of each cup. It is understood that the steps described above are not necessarily performed in the order as described and variations of the order are possible which can be made by a person of ordinary skill in the art.

Figure 7:
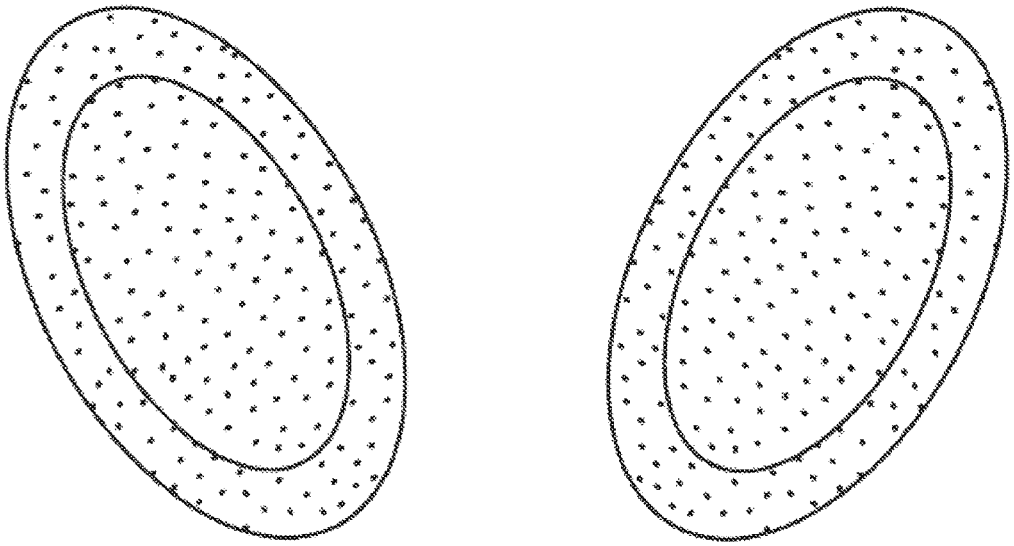
FIG. 7 shows an exemplary pair of extra filling on the cups for further shaping and uplifting effects.

Optionally, an extra filling, such as, for example, polyurethane foam, fiberfill, oil sac, gel sac, air sac or silicone sac, which may be formed into a shape shown in FIG. 7, can be sandwiched between outer and inner cup panels during the molding process (of course, with proper selection of the male and female of the mold so as to provide necessary room for the extra filling.

While there have been described and pointed out fundamental novel features of the invention as applied to a preferred embodiment thereof, it will be understood that various omissions and substitutions and changes, in the form and details of the embodiments illustrated, may be made by those skilled in the art without departing from the spirit of the invention. The invention is not limited by the embodiments described above which are presented as examples only but can be modified in various ways within the scope of protection defined by the appended patent claims.

What is claimed is:

1. A single brassiere support provided in right and left cups of a brassiere, the brassiere support having an X shape and comprising four forks joined at a joint point at a bridge portion between the right and left cups and which is in molded 3-dimensional configuration conforming to a shape of the right and left cups, wherein the four forks include an upper right fork, a lower right fork, an upper left fork and a lower left fork, wherein the right cup includes a lower area that extends from a lower end of the bridge portion up to a side area, the side area extending to a shoulder strap attachment area, the shoulder strap attachment area extending to an upper area, and the upper area extending to an upper end of the bridge portion, wherein the left cup includes a lower area that extends from the lower end of the bridge portion up to a side area, the side area extending to a shoulder strap attachment area, the shoulder strap attachment area extending to an upper area, and the upper area extending to the upper end of the bridge portion, wherein the upper right fork extends from the upper end of the bridge portion and along an inside portion of the upper area of the right cup and the lower right fork extends from the lower end of the bridge portion, along an inside of the lower area of the right cup and terminates at a distal end thereof at a lower portion of the lower area of the right cup that is before the side area of the right cup, such that a distal end of the upper right fork is positioned higher on the brassiere than the distal end of the lower right fork, and wherein the upper left fork extends from the upper end of the bridge portion and along an inside portion of the upper area of the left cup and the lower left fork extends from the lower end of the bridge portion, along an inside of the lower area of the left cup and terminates at a distal end thereof at a lower portion of the lower area of the left cup that is before the side area of the left cup, such that a distal end of the upper left fork is positioned higher on the brassiere than the distal end of the lower left fork.

2. The brassiere support of claim 1, which is made of 100% ethylene vinyl acetate.

3. The brassiere support of claim 1, wherein the upper right fork terminates in the upper area of the right cup before the shoulder strap attachment area of the right cup and the upper left fork terminates in the upper area of the left cup before the shoulder strap attachment area of the left cup.

4. An unwired brassiere, comprising a single X shaped support and right and left cups, said X shaped support comprising four forks joined at a joint point at a bridge portion between said right and left cups and which is in molded 3-dimensional configuration conforming to a shape of said right and left cups, and said right and left cups comprising an outer panel and an inner panel between which said X-shaped support is sandwiched, wherein the four forks include an upper right fork, a lower right fork, an upper left fork and a lower left fork, wherein the right cup includes a lower area that extends from a lower end of the bridge portion up to a side area, the side area extending to a shoulder strap attachment area, the shoulder strap attachment area extending to an upper area, and the upper area extending to an upper end of the bridge portion, wherein the left cup includes a lower area that extends from the lower end of the bridge portion up to a side area, the side area extending to a shoulder strap attachment area, the shoulder strap attachment area extending to an upper area, and the upper area extending to the upper end of the bridge portion, wherein the upper right fork extends from the upper end of the bridge portion and along an inside portion of the upper area of the right cup and the lower right fork extends from the lower end of the bridge portion, along an inside of the lower area of the right cup and terminates at a distal end thereof at a lower portion of the lower area of the right cup that is before the side area of the right cup, such that a distal end of the upper right fork is positioned higher on the brassiere than the distal end of the lower right fork, and wherein the upper left fork extends from the upper end of the bridge portion and along an inside portion of the upper area of the left cup and the lower left fork extends from the lower end of the bridge portion, along an inside of the lower area of the left cup and terminates at a distal end thereof at a lower portion of the lower area of the left cup that is before the side area of the left cup, such that a distal end of the upper left fork is positioned higher on the brassiere than the distal end of the lower left fork.

5. The unwired brassiere of claim 4, wherein said outer panel and inner panel each comprising a foam layer and a fabric layer with said foam layers of said outer panel and inner panel facing each other and said X-shaped support is in contact with said foam layers of said outer panel and inner panel.

6. The unwired brassiere of claim 5, wherein said joint point of said X shaped support is positioned at the bridge portion that connects said right and left cups of said brassiere.

7. The unwired brassiere of claim 6, wherein said lower right fork of said X shaped support is aligned with a rim portion of said right cup and said lower left fork is aligned with a rim portion of said left cup.

8. The unwired brassiere of claim 4, wherein the X shaped support extends continuously from one of said right and left cups to the other of said right and left cups.

9. The unwired brassiere of claim 4, wherein the upper right fork terminates in the upper area of the right cup before the shoulder strap attachment area of the right cup and the upper left fork terminates in the upper area of the left cup before the shoulder strap attachment area of the left cup.

10. A method of fabricating an unwired brassiere, comprising the steps of: (a) making an outer cup panel by laminating a fabric sheet on a foam sheet, (b) making an inner cup panel by laminating a fabric sheet on a foam sheet, (c) molding said outer cup panel to form right and left cups, (d) making a single X shaped support by cutting from a sheet material, (e) applying adhesive on a foam surface of said outer cup panel, on one or two surfaces of said X shaped support, and on a foam surface of said inner cup panel, (f) placing said X shaped support on said foam surface of said inner cup panel to form an assembly, and (g) placing said outer cup panel on a female portion of a mold, placing said assembly on said outer cup panel, placing a male portion of said mold on said assembly, and then clamping said female and male portions of said mold for a period of time to obtain the right and left cups supported by said X shaped support, wherein said X shaped support comprises four forks joined at a joint point at a bridge portion between the right and left cups, the four forks including an upper right fork, a lower right fork, an upper left fork and a lower left fork, wherein the right cup includes a lower area that extends from a lower end of the bridge portion up to a side area, the side area extending to a shoulder strap attachment area, the shoulder strap attachment area extending to an upper area, and the upper area extending to an upper end of the bridge portion, wherein the left cup includes a lower area that extends from the lower end of the bridge portion up to a side area, the side area extending to a shoulder strap attachment area, the shoulder strap attachment area extending to an upper area, and the upper area extending to the upper end of the bridge portion, wherein the upper right fork extends from the upper end of the bridge portion and along an inside portion of the upper area of the right cup and the lower right fork extends from the lower end of the bridge portion, along an inside of the lower area of the right cup and terminates at a distal end thereof at a lower portion of the lower area of the right cup that is before the side area of the right cup, such that a distal end of the upper right fork is positioned higher on the brassiere than the distal end of the lower right fork, and wherein the upper left fork extends from the upper end of the bridge portion and along an inside portion of the upper area of the left cup and the lower left fork extends from the lower end of the bridge portion, along an inside of the lower area of the left cup and terminates at a distal end thereof at a lower portion of the lower area of the left cup that is before the side area of the left cup, such that a distal end of the upper left fork is positioned higher on the brassiere than the distal end of the lower left fork.

11. The method of claim 10, wherein said X shaped support is made of 100% ethylene vinyl acetate.

12. The method of claim 10, wherein, in step (f), said single X shaped support is placed so as to coincide with a central portion and a lower portion of said inner cup panel.

13. The method of claim 10, wherein the upper right fork terminates in the upper area of the right cup before the shoulder strap attachment area of the right cup and the upper left fork terminates in the upper area of the left cup before the shoulder strap attachment area of the left cup.

* * * * *